US006073466A

United States Patent [19]

Marchesi et al.

[11] Patent Number: 6,073,466

[45] Date of Patent: Jun. 13, 2000

[54] METHOD AND EQUIPMENT FOR RESTRAINING WHILE KNITTING THE END PORTIONS OF CUT THREAD PROTRUDING FROM COLLARS FOR KNIT-WEAR ARTICLES AND THE LIKE

[75] Inventors: Mario Marchesi; Riccardo Marchesi; Lorenzo Marchesi, all of Florence, Italy

[73] Assignee: A.R.M.I.-Assistenza Ricambi Macchine Industriali S.R.L., Florence, Italy

[21] Appl. No.: 09/194,152

[22] PCT Filed: Jun. 2, 1997

[86] PCT No.: PCT/EP97/02859

§ 371 Date: Nov. 23, 1998

§ 102(e) Date: Nov. 23, 1998

[87] PCT Pub. No.: WO97/45579

PCT Pub. Date: Dec. 4, 1997

[30] Foreign Application Priority Data

May 31, 1996 [IT] Italy ..... PI96A0032

[51] Int. Cl.[7] ..... D04B 15/00

[52] U.S. Cl. ..... 66/145 S; 139/434

[58] Field of Search ..... 66/145 B, 127, 66/125 A, 125 R, 145 S, 145 R; 139/434

[56] References Cited

U.S. PATENT DOCUMENTS 4,957,144 9/1990 Watanabe et al. ..... 139/434
5,316,050 5/1994 Bertsch ..... 139/434
5,613,377 3/1997 Marchesi et al. ..... 66/145 S

FOREIGN PATENT DOCUMENTS 723 362 8/1942 Germany .
WO 88/08892 11/1988 WIPO .

OTHER PUBLICATIONS

Patent Abstracts of Japan, vol. 17, No. 176 (C–1045), Apr. 6, 1993 & JP 04 333648.

*Primary Examiner*—Danny Worrell
*Attorney, Agent, or Firm*—Browdy and Neimark

[57] ABSTRACT

A method and an apparatus, applicable to a knitting machine for the production of collars and the like, for restraining while knitting end portions of cut thread (12, 13) protruding from the edge (5) of said collars into the stitches that compose them. The means for introduction (16) of said thread ends (12, 13) among two next courses of stitches comprises fluid currents (22, 32) that catch the end portions and align them to the stitches while knitting. A combing step of the end portions and stretch them when passing may be provided for. A mobile blowing head (16) and a mobile nozzle (27) are provided for suited to produce said fluid currents (22, 32) while knitting and lower in order not to interfere with thread support means (8, 28). The and portions (12, 13) are restrained among the stitches of the collar without leaving portions or loops protruding from the edge. In order to make easier the separation of the collars, the thread of union of the collars is advantageously cut forming two thread ends which are restrained in turn among the stitches in the same way of the threads which form the collars.

13 Claims, 7 Drawing Sheets

Fig. 3
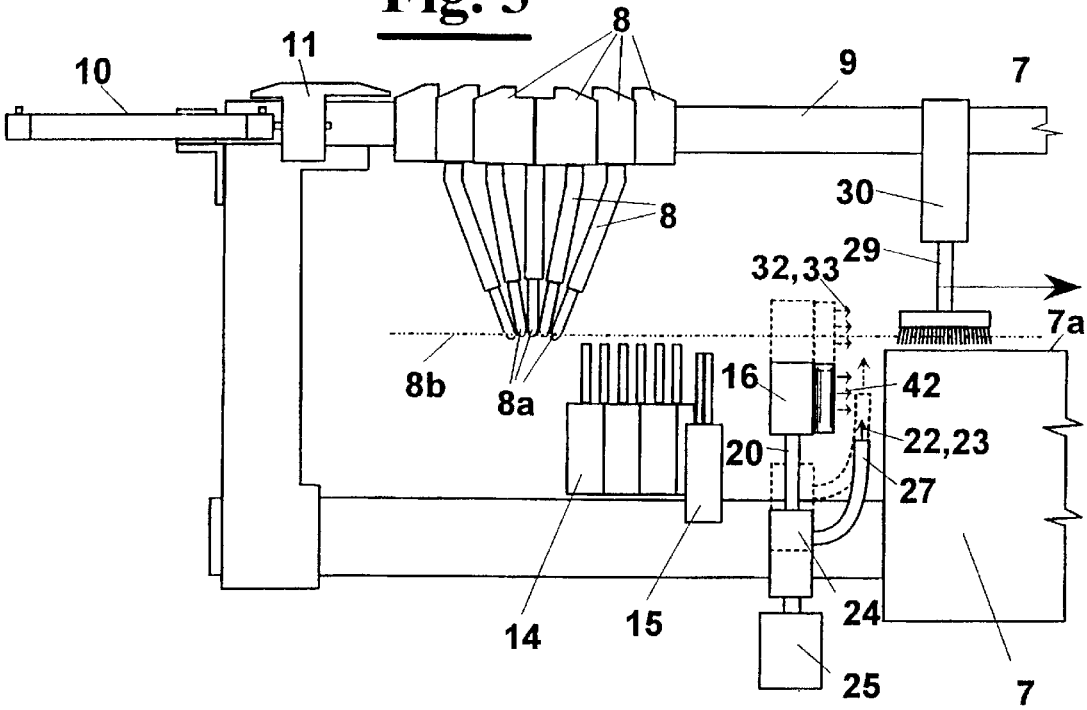
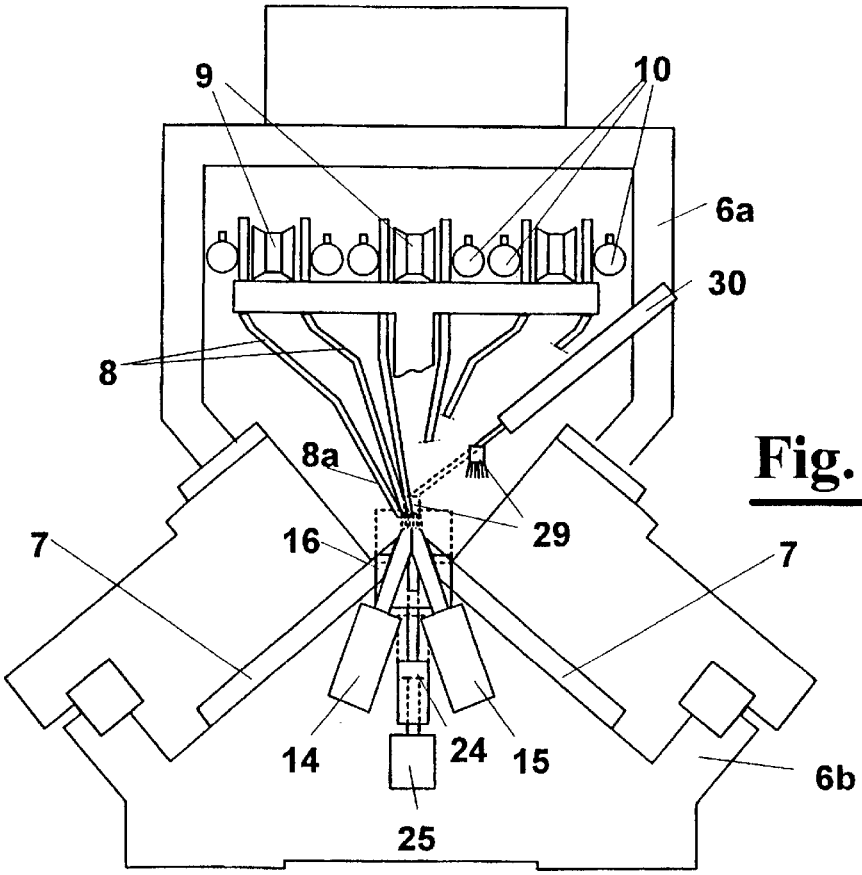
Fig. 4

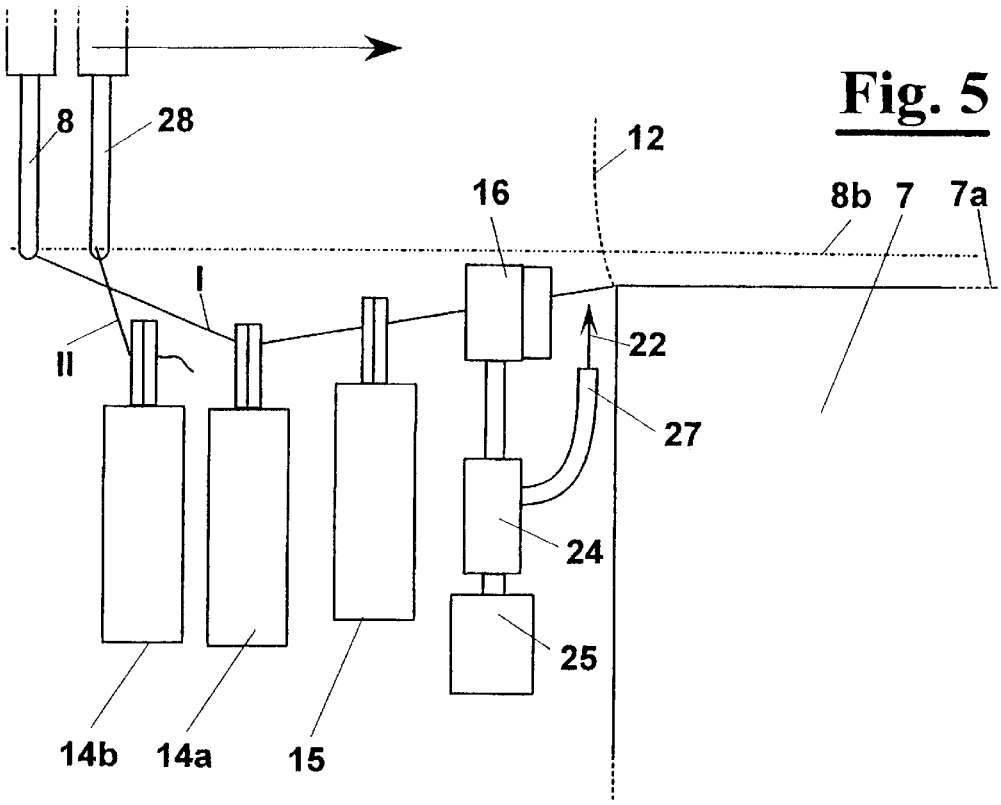
Fig. 5
Fig.6
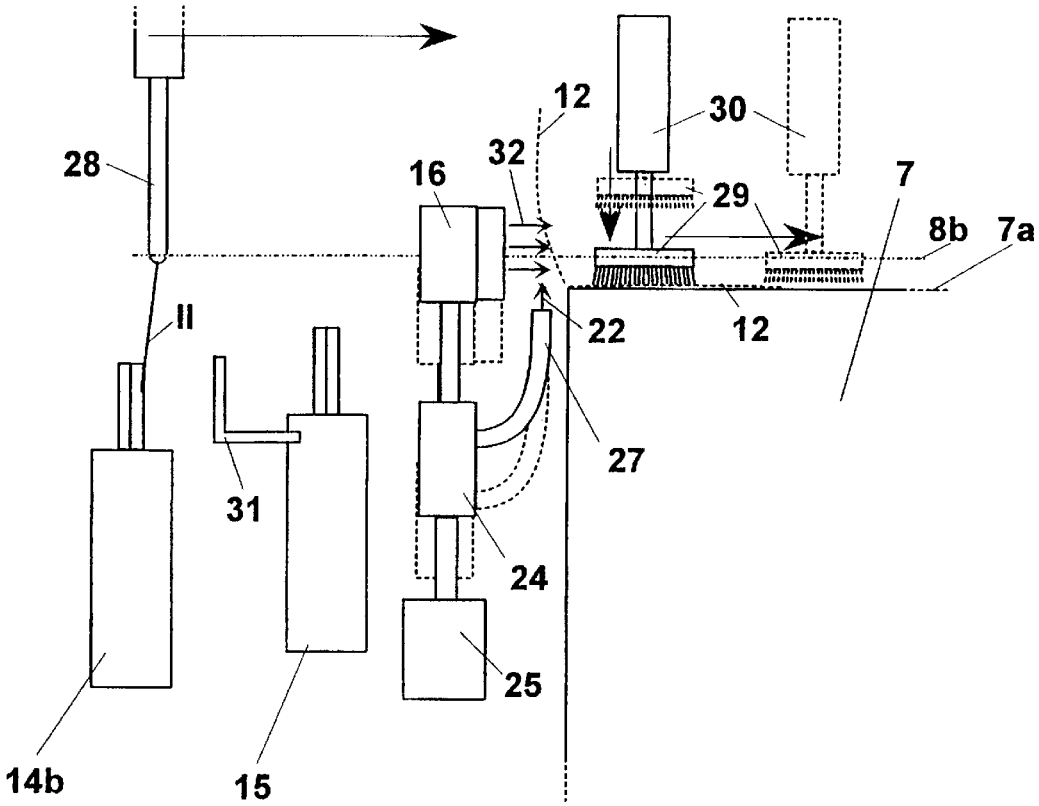

Fig. 13
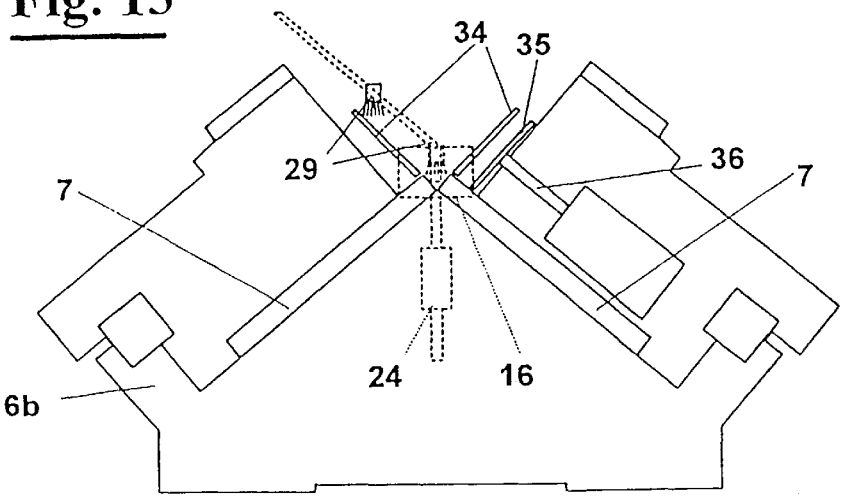
Fig. 14
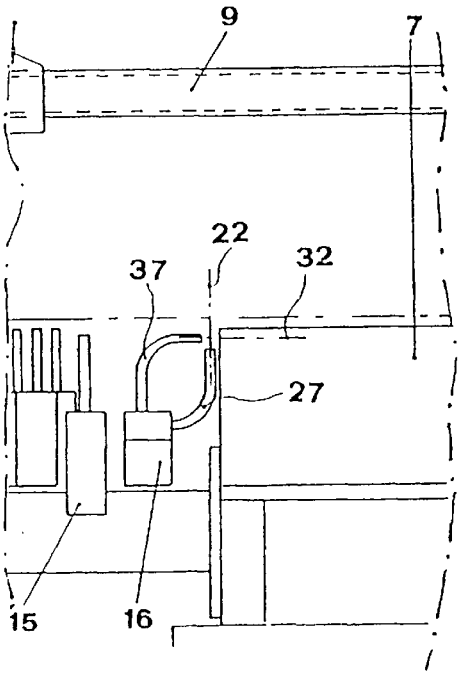
Fig. 15
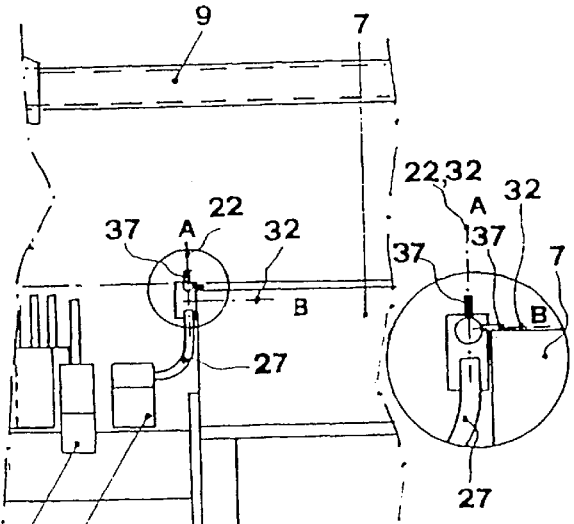
Fig. 15A

METHOD AND EQUIPMENT FOR RESTRAINING WHILE KNITTING THE END PORTIONS OF CUT THREAD PROTRUDING FROM COLLARS FOR KNIT-WEAR ARTICLES AND THE LIKE

DESCRIPTION

1. Field of the Invention

The present invention relates to the field of textiles and, more precisely, to a method for restraining the terminal portions of cut thread protruding from collars for knit-wear and similar articles by inserting them inside the stitches which compose the articles during the course of knitting. The invention relates also to a method for making easier the separation of collars after knitting.

The invention, furthermore, relates to an apparatus for carrying out said methods.

2. Description of the Prior Art

Collars used for making knit-wear articles are knitted in strips, attached in turn to one another along one common side by means of provisional stitches which can be eliminated pulling a thread of union. At the end of the knitting, and after a possible dyeing step, every collar is attached to the previous and to the next not only by said thread of union but also by the thread itself of the stitches forming a loop at the side of union. Each collar can be of a solid color or comprise one or more bands of color, just as it can have multicolor designs on a background color.

After separating the collars, it is necessary to insert the ends of the cut thread inside the stitches of thread that form the collar, so that they do not protrude from the collar disturbing its aesthetic value. It is necessary to insert the end portions in the stitches in such a way that they cannot easily come cut.

For collars of a solid color, the operation is carried out only once, since, of the two end portions of thread which protrude from each collar, one will be directly inserted into the stitches with which the collar will be attached to the knit article.

On the other hand, when collars comprise more than one color, two additional ends of thread protrude from the edge for every color change. For example, for a collar having a band of color different from the background color, in the finishing steps, it will be necessary to insert five thread ends (four for the two changes in color and one at the end), whereas for a collar with two bands of color different from the background, it will be necessary to insert nine thread ends (eight for four color changes and one at the end).

The inserting step can be made manually, when the collars are finished, or automatically, while knitting.

The manual insertion, is carried out by inserting a special needle inside a portion of knitted collar until reaching the edge corresponding to the point from which the end portion of the thread extends. The end portion is then pulled inside the collar where it is restrained and hidden by the course of stitches forming the knit collar. This step requires skill and the use of a special needle, and is expensive, in particular when the collars present bands of color.

There is a known machine for the production of collars in which the operation of inserting the ends of protruding thread is performed during knitting by a mechanical needle. As the ends are produced, the needle inserts them between two successive courses of stitches, awaiting the moment of knitting to be withdrawn so that each end portion is restrained inside. However, in order to prevent the needle, when it withdraws, from dragging the thread end with it, pulling it newly out of the knitting, collars produced with this type of machine, have a tubular course of stitches which locally increases the thickness of the collar creating a poor aesthetic effect. Furthermore, this type of mechanism is even less appropriate when the knitting is very thin, since, in this case, the above-mentioned effect would be accentuated.

Another problem arises when separating the collars, in the steps of cutting and pulling away the connecting thread. In fact, the cutting step of the connecting thread is critical if operated automatically, since it could result in a damage for the collars.

SUMMARY OF THE INVENTION

The object of the present invention is, therefore, to provide a method for inserting the ends of thread protruding from the edges of collars and similar knit articles into the collar stitches, while knitting, which does not incur any of the above-mentioned inconveniences and which, at the same time, is simple to carry out.

It is another object of the present invention to provide a method for simplifying the separation step of the collars and in particular the cutting step of the connecting thread.

It is further object of the present invention to provide an apparatus which carries out such method.

These and other objects are accomplished by the present invention, whose method is characterized by the fact that the step of catching and inserting the end of the thread occurs by means of at least one current of fluid. After every insertion of a thread and in the stitches while knitting, a stretching step of the thread end waiting to be restrained in the stitches itself is provided for. The stretching step is preferably carried out by means of a brush element that lowers on the thread and combing it while moving.

Preferably, two coplanar and orthogonally directed jets of a fluid, such as air or water, are provided for. The first jet catches the thread end at the time of the cut and orients it in a direction which is not parallel to the knitting, whereas the second jet, which intervenes after the first, aligns the portion of thread with two consecutive courses of stitches, so that they include it at the time of knitting the preceding and following ones.

Advantageously, one of the two jets of fluid accompanies the thread end by means of a rotation in said plane, from a position aligned with the first jet to a position aligned with the two ranks of stitches during knitting.

In the case of knitting a first (collar with a first thread and then a second collar with a second thread, the thread end of the first thread is advantageously sucked by a fluid current and aligned under the stitches while knitting, thereby the restraining step of the second thread end can be carried out without that the first thread end is involved.

In order to make easier the separation of the collars, the thread of union is advantageously cut forming two thread ends which are restrained in turn among the stitches in the same way of the threads which form the collar.

The apparatus which carries out said method is characterised by the fact that it comprises at least one nozzle connected by means of the emission of fluid under pressure and mobile brush means with actuator means that locate the brush means tangentially to said end portions combing them when moving. Preferably, it comprises two nozzles communicating with a network of compressed air through electrovalves.

According to a first advantageous embodiment, blowing means comprising said nozzles are provided for mounted on actuator means that maintains in lowered position while knitting and raises selectively at the same time of the emission of air jets suited to catch said thread end portions.

Alternatively, according to a second advantageous solution, the second nozzle is mounted on a rotatable support and can be oriented between two positions in which the jet coming out of it is aligned respectively with the jet of the first nozzle and with the two courses of stitches being knitted. The first nozzle is positioned in proximity to the edge of the knit article in order to catch the protruding ends of thread immediately after that they have been cut.

BRIEF DESCRIPTION OF THE DRAWINGS

Further characteristics and advantages of the method and the apparatus according to the present invention will become more apparent in the description which follows of some of its embodiments, given as an example and not limitative, with reference to the attached drawings in which:

FIG. 3 shows an elevational side view of a machine for collars comprising an apparatus according to the invention;

FIG. 4 shows a front view of the machine of FIG. 3;

FIGS. 5, 6 and 7 show a lateral diagrammatic view of the restraining steps of a thread end in the stitches while knitting;

FIG. 13 shows a partial rear view of the machine of FIG. 3;

FIGS. 14 and 15 show a partial side view of two different embodiments of the machine of FIG. 3;

FIG. 15A is an enlarged view of the circled area in FIG. 15;

DESCRIPTION OF PREFERRED EMBODIMENTS

Figure 1:
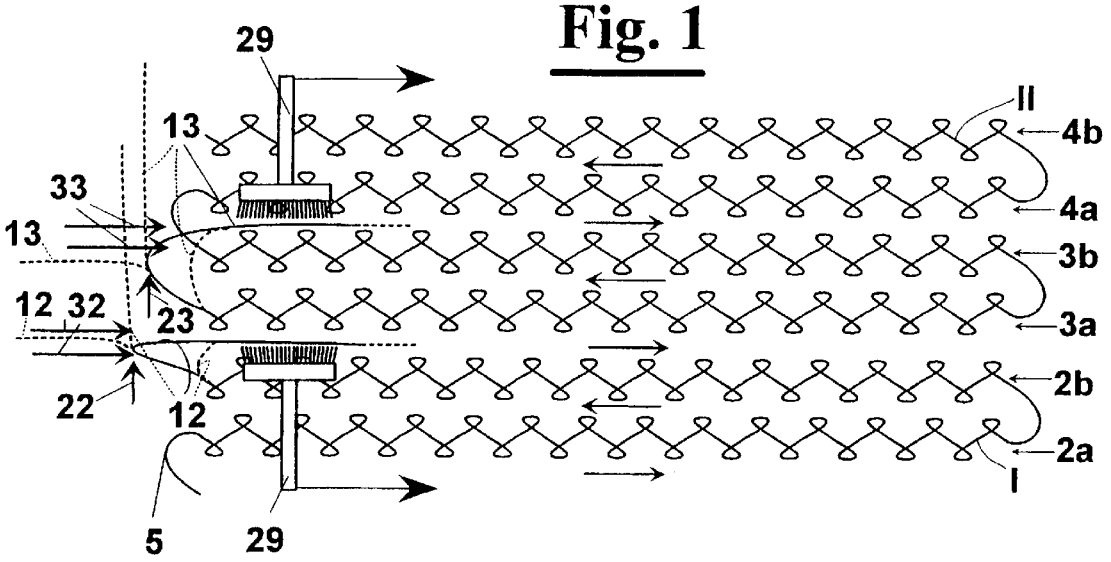
FIG. 1 shows a diagrammatic view of the steps according to the invention of introduction by means of fluid currents of thread end portions protruding from the edge of a collar among consecutive courses of stitches in case of change of color of the thread within a same collar.
Figure 2:
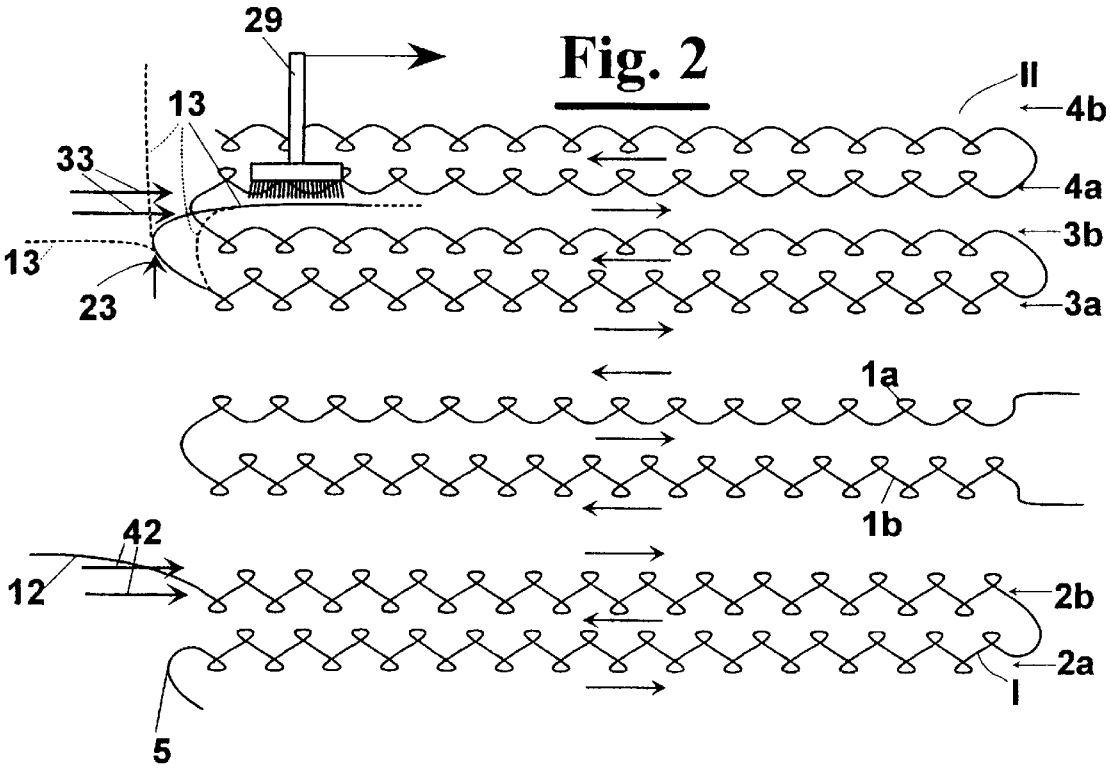
FIG. 2 shows a diagrammatic view of the steps according to the invention of introduction by means of fluid currents of thread ends protruding from the edge of a second collar among consecutive courses of stitches in the case of knitting a first collar and then knitting of a second collar.

In the case in which a change of color or the separation of two adjacent collars is carried out while knitting, it is possible that what diagrammatically shown in FIGS. 1 and 2 occurs, with a first and a second course of stitches indicated respectively with 2*a* and 2*b,* from which extends, at the moment of thread change, a thread end 12. The consecutive courses of stitches, here illustrated separate from one another for the sake of clarity, are obviously, in reality, knitted together.

With reference to FIG. 1, in the passage from course 2*b* and a course 3*a,* when it is necessary to change a thread I into a thread II, for example of different color, free thread end 12 and 13 are formed, both protruding from the edge 5 of the stitches.

According to the present invention, end portions 12 and 13 are introduced, while knitting, respectively among the courses of stitches 2*b* and 3*a* and among the next courses of stitches 3*b* and 4*a*. The letters a and b indicate respectively the courses of stitches knitted forth and back during the strokes of the carriage of the knitting machine described hereinafter.

More precisely, with the numerals of FIG. 1, course 2*a* is knitted from left to right and then, with the same thread I of course 2*b,* from right to left. In case of thread change, at edge 5, first thread I is kept by a pliers and cut, so that the thread end 12 of thread I is freed and protrudes from edge 5 itself.

The insertion method provides that end 12 of thread I is caught first by an air current 22 that orients thread end 12 orthogonally to the stitches, preferably towards the above, and then by an air current 32 that orients thread end 12, parallelly to course 2*b* before that knitting of course 3*a* by a thread II starts, in order to insert it completely between the stitches with respect to the edge 5. The knitting of course 3*a,* from left to right, restrains the thread end 12 between course 3*a* and course 2*b*. Then, end 13 of thread II is freed and protrudes from edge 5. Before knitting of course 4*a* starts, an air current 23 catches thread end 13 and orients it according to its direction, orthogonally to the stitches, and allows an air current 33 to catch it in turn and to align it to course 3*b,* so that the knitting of course 4*a* with the same thread II restrains thread end 13 between course 3*b* and course 4*a* itself In a similar way, as shown in FIG. 2, course 2*b* may belong to a collar and course 3*a* to another, and in this case end portions 12 and 13 are made of the same thread, but are separated by one or more courses of thread of union 1*b* and 1*a,* knitted with the interposition of idle strokes of the carriage. In this case, only the thread end 13, as above described, must be restrained, whereas the thread end 12 must be left free because, in a second moment, is restrained in the stitches of the article to which the collar is stitched, after the separation of the collars.

According to a preferred embodiment of the invention, for both the end portions of thread 12 and 13, in the case of FIG. 1, or only for thread end 13, in the case of FIG. 2, after the catching and inserting steps by means of currents 32 and 33 (or only 33), combing steps are provided for by means of a brush 29 that maintains the end portions themselves aligned with the previous course of stitches waiting that it is restrained by the next course.

In the case of FIG. 2, according to a preferred embodiment of the method, the thread end 12 is located under the stitches by a sucking air current 42, to prevent currents 23 and 33 from catching and restraining it together to thread end 13 and causing the above described drawback.

With the method according to the present invention, therefore, the insertion of thread ends 12 and 13 is carried out automatically in the course of knitting, with considerable advantage with respect to manual inserting and, in any case, with advantage with respect to the mechanical insertion described above, since it is not necessary to introduce a needle or other equivalent means between two successive courses of stitches during knitting, which would cause a modification of the form of the knit article as described above.

With reference to FIGS. 3 and 4, a knitting machine of known type for the production of collars and the like comprises a carriage 6*a,* sliding on a basement 6*b,* and two needle arrays 7. The machine also comprises thread supports 8 sliding on guides 9 and whose stroke is limited by a block 11 operated by pneumatic means 10. Every thread support 8, dragged selectively by carriage 6*a,* brings to the needles residing in the needle array 7, by means of its end 8*a* which moves on a rectilinear trajectory 8*b,* a thread of different color or of different quality and each free thread end is kept by pliers 14. In the passage from a type of thread to the next, the thread support 8 having the previous thread withdraws an(i one of the pliers 14 grips it. Then, a cutter 15 cuts such thread leaving free one of the thread ends above described and indicated in FIG. 1 with 12 or 13.

According to a preferred embodiment of the invention, as shown in FIGS. 3 and 4, a brush 29 is provided for operated by an actuator 30, which can translate integrally to carriage 6*a*. Brush 29, when pushed by actuator 30, can touch the stitches while knitting and substantially "comb" them, in particular stretching the thread end which lies on it waiting to be restrained by the next course of stitches.

Always according to the invention, a restraining apparatus applicable to a knitting machine for collars comprises a blowing head 16, oriented horizontally, and a nozzle 27 oriented vertically, also shown in FIGS. 3 and 4. Head 16 and nozzle 27 are integral to a block 24, mounted on a pneumatic actuator 25. As better shown in FIGS. 9, 10 and 11, head 16 presents a central groove 17 and a couple of nozzles 18, parallel, oriented towards deflector 19. A tubular stem 20 brings compressed air from block 24 towards head 16.

With reference to FIGS. 5 and 6, the restraining step, in the case of FIG. 1, is carried out as follows. Thread I, brought by a thread support 8 and by which course 2*b* of the collar is being knitted, is kept still by one of pliers 14 and is then cut by cutter 15, freeing a thread end 12. At the same time of the cut, an air jet 22 coming from nozzle 27, which in this step is kept in a lowered position under the intersection line 7*a* of the two needle arrays 7, creates an air current: directed upwardly which orients thread end 12 in a substantially vertical direction. At the same time (FIG. 6), actuator 25 raises block 24 and, with it, head 16 and nozzle 27, which is continuing to blow and which stops only when head 16 starts blowing emitting an air current 32. The latter current aligns thread end 12 with line 7*a*. Therefore, a second thread support 28 starts knitting thread II and restrains thread end 12 among the stitches. Actuator 25, in the meantime, lowers again in the first position of FIG. 5 and thread guide 28 can pass following trajectory 8*b*. Always with reference to FIG. 6, before that knitting of course 3*a* starts, thread end 12 is aligned with the stitches but has not yet been restrained and is not necessarily stretched according to a rectilinear shape, since jet air 32 has only oriented it in that direction. At that point, brush 29, pushed by actuator 30, lowers and combs it. At the passage of thread guide 28, which knits course 3*a* while brush 29 is withdrawing, thread end 12 is eventually restrained and hidden among the stitches of the collar, without leaving portions or loops protruding from the edge.

Figure 7:
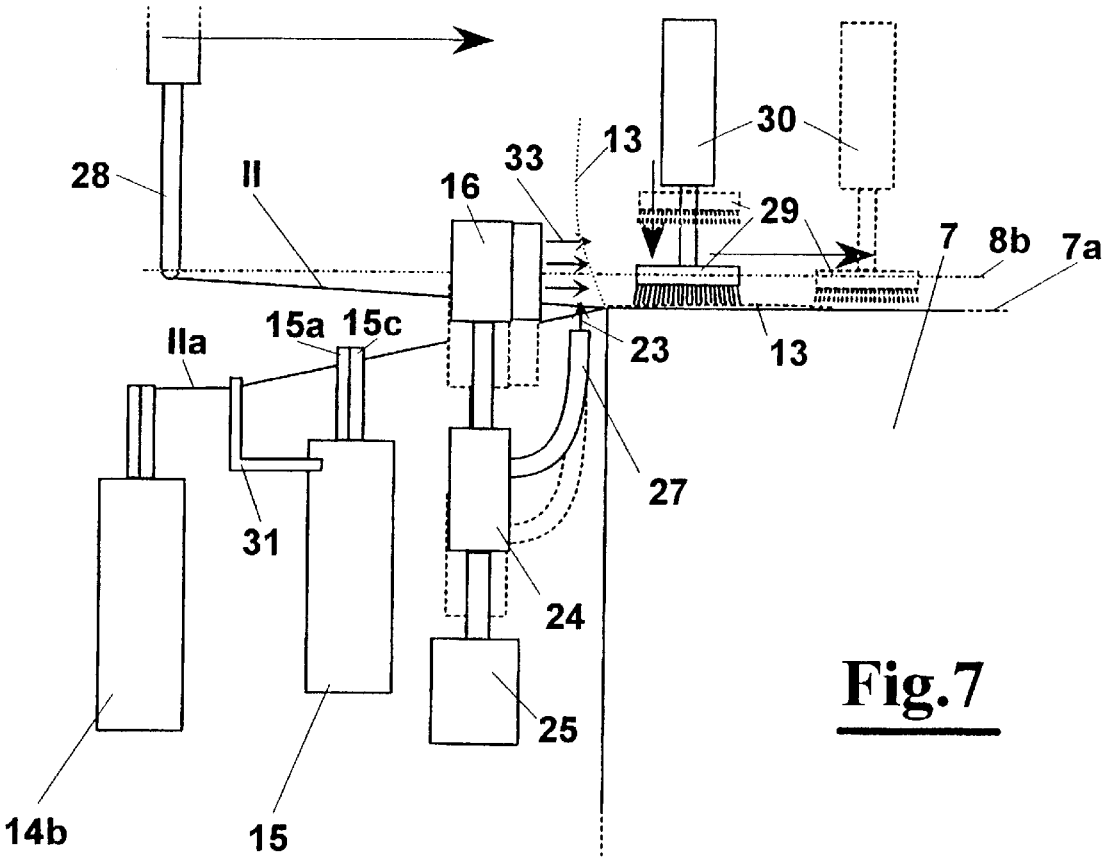

As shown in FIG. 7, after that thread guide 28 has come back after knitting the two courses of stitches, one forth 3*a* and one back 3*b,* end IIa of thread II, kept by pliers 14*b,* is cut by cutter 15, freeing a thread end 13. In a way similar to FIGS. 5 and 6, jet air 23, coming from nozzle 27, aligns vertically thread end 13. Therefore, air current 33, coming from head 16, is emitted after that actuator 25 has raised block 24 and, with it, head 16 and nozzle 27, which was continuing to blow and which stops only when jet 33 starts blowing. Then, actuator 25 lowers again and brush 29 repeats the above described movement, combing thread end 13. Thread support 28, then, starts knitting two further courses of stitches, one forth 4*a* and one back 4*b,* the former restraining thread end 13 which is hidden among the stitches of the collar, without leaving portions or loops protruding from the edge.

Figure 8:
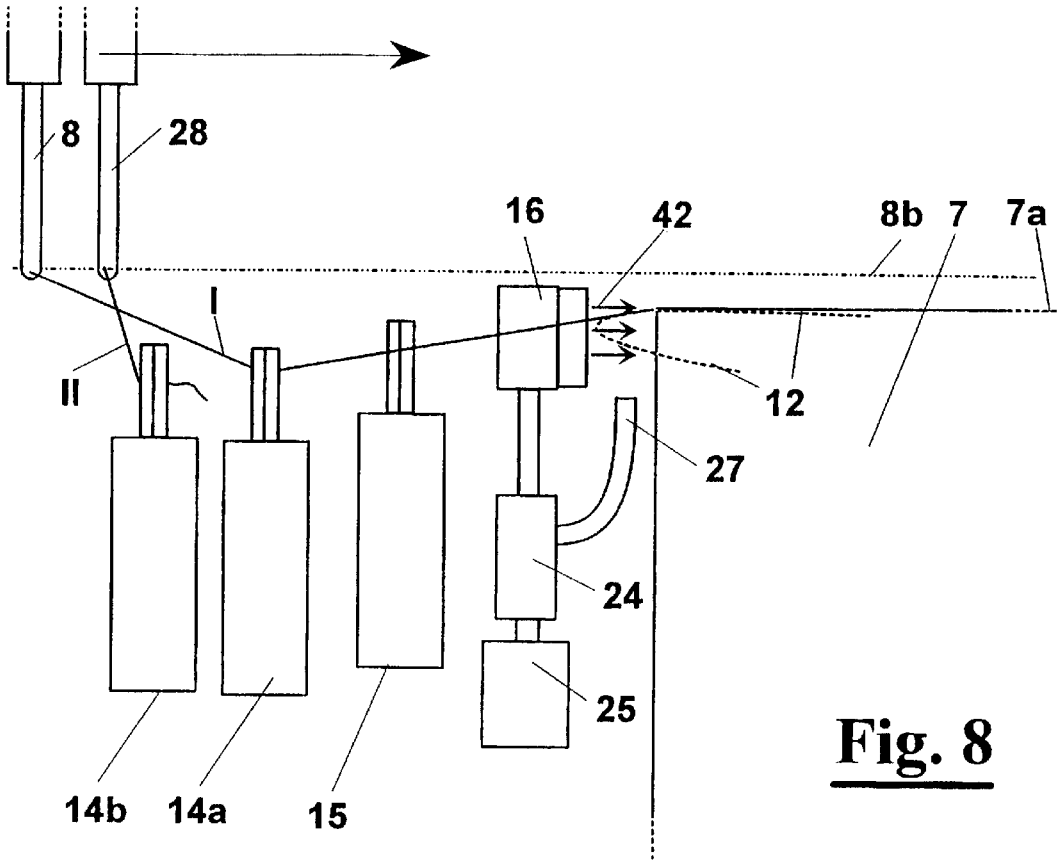
FIG. 8 shows a lateral diagrammatic view of the sucking steps of a thread end under the stitches while knitting, in the case of knitting a first collar and then a next one.

With reference now to FIG. 8, in the case of FIG. 2, thread I brought by thread guide 8 and by which the first collar had been knitted up to that point, is kept still from one of pliers 14 and is then cut by cutter 15 freeing thread end 12. At the same time, an air jet 42 coming from head 16, which at this step is under line 7*a,* produces an air current which drags thread end 12 under the needle arrays 7. Jet 42, in other words, produces a sucking current thanks to the lowered position of head 16. At this point, the thread of union is knitted, in the two courses 1*a* and 1*b,* and then second thread support 28 starts knitting thread II and restrains thread end 13 among the stitches, in the same way described in FIGS. 5 and 6 or 7. However, since the first courses of stitches knitted with thread II are of tubular type, that is they are knitted alternatively with the needles of only one needle array at a time, more strokes are required before that thread end 13 is restrained. Therefore, more passages of brush 29 are done since a course of stitches is knitted with the needles of both the needle arrays thus restraining thread end 13.

Figure 9:
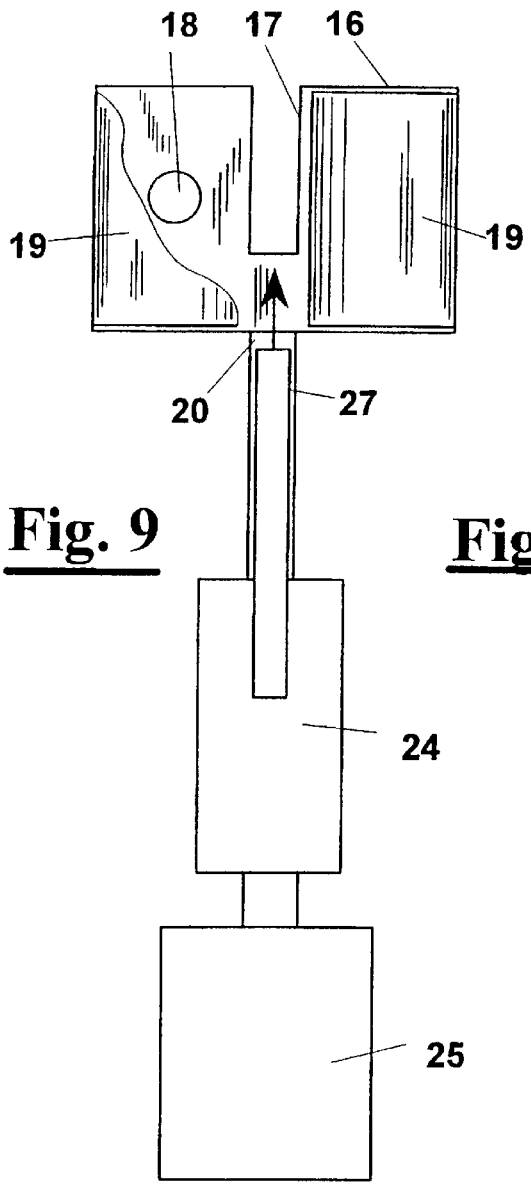
FIGS. 9, 10 and 11 show a partially sectioned view respectively elevational front, elevational lateral and top plan of a mobile head for the emission of air jets.
Figure 10:
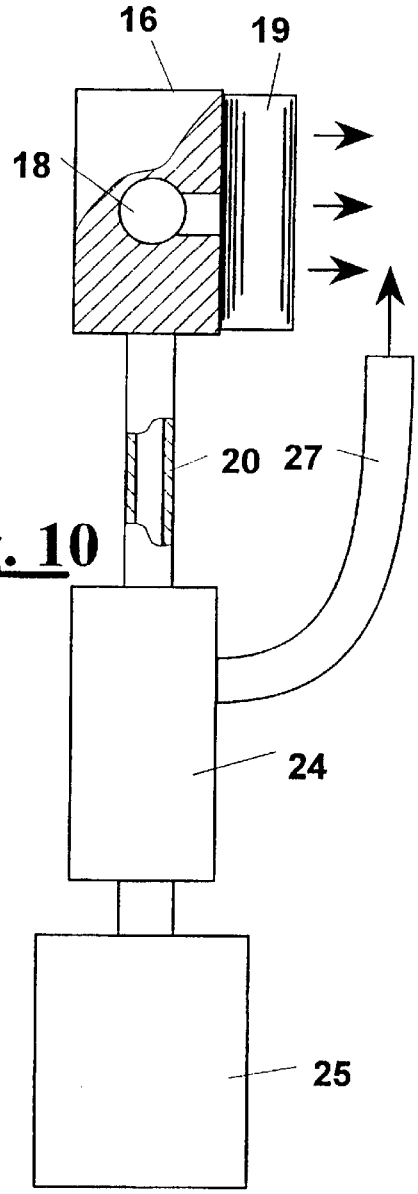
Figure 11:
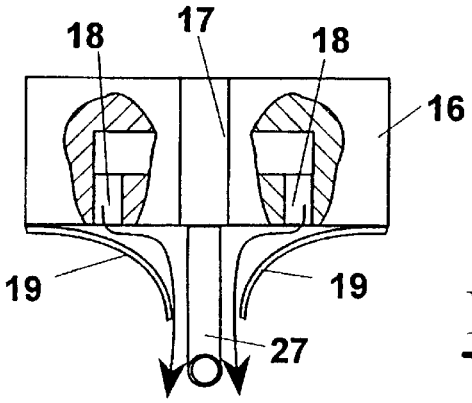

The particular shape of blowing head 16 and its possibility of moving vertically has the following advantages:

- head 16 may remain lowered with respect to the needle arrays allowing the passage of thread guide 8 without interference;
- the thread can pass while knitting through groove 17, (FIGS. 9 and 11) without interference with blowing head 16 when this is in a raised position;
- central groove 17 does not prevent head 16 from producing an effective blow thanks to the presence of eccentric nozzles 18 and of deflector 19 (FIGS. 9, 10 and 11).

Figure 12:
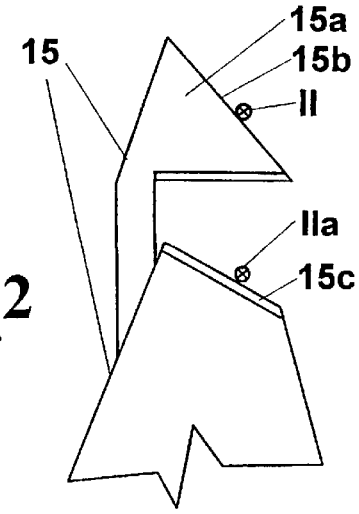
FIG. 12 shows a partial elevational front view of a thread cutter

With reference to FIG. 12, cutter 15 can advantageously have a mobile blade 15*a* having an inclined upper profile 15*b*. A fixed blade 15*c,* Located underneath, has the task of cutting end 13 of thread IIa kept from the pliers 14*b* (FIG. 6). Inclined profile 15*b* has the task of preventing thread II, while brought by thread guide 28, from being cut together with thread end IIa, since it is effective to cut the latter when the carriage is on the left, in order to be able to start again knitting as soon as possible. In fact, owing to the different inclination with respect to thread II, thread end IIa, when the mobile blade raises, overcomes profile 15*b* and locates on fixed blade 15*c*. On the other hand, thread II cannot exceed the profile 15*b* and keeps distant from fixed blade 15*c* even when mobile blade lowers again for cutting thread end IIa. Since, while overcoming inclined profile 15*b,* thread end II would tend to loosen and therefore to be not cut by the cutter, a resilient hook 31 (FIGS. 6 and 7) is provided for re-establishing the stress of the thread end IIa after the overcoming of inclined profile 15*b*.

As shown in FIG. 13, plate means can be provided for on the knitting machine for preventing the thread end from being aligned outside the knitting line 7*a* comprised between the two needle arrays. Such plate means can comprise two opposite plates 34 arranged laterally to the knitting line 7*a,* and/or a pusher 35 operated by a piston 36. In particular, plates 34 can be approached to line 7*a* before that head 16 starts blowing air jets 32 or 33, whereas pusher 35 is operated after every passage of brush 29, in case the thread end would accidentally come out from knitting line after stretching.

With reference now to FIGS. 14, 15, and 15A instead of head 16 raising or lowering itself, along with first nozzle 27, a second nozzle 37 can be provided lying on line 7*a*. In the former figure, second nozzle 37 is fixed, whereas in the latter figure second nozzle 37 is mobile and can rotate from a position A to a position B correspondingly directing the air jet 32 coming from it. In this way, the inserting step of the thread end occurs in the following manner. The first jet of air 22 coming out of nozzle 27 catches the end portion of thread aligning it with itself as well as with the second jet of air 32 coming from nozzle 37 in position A. Then second jet of air 37 turns from position A to position B carrying with it the end portions of thread to align it with the course of stitches while knitting. In this way, there is no discontinuity in the passage from the hold of air jet 22 to the hold of air jet 32 and a greater precision of insertion of the thread is obtained.

Figure 16A:
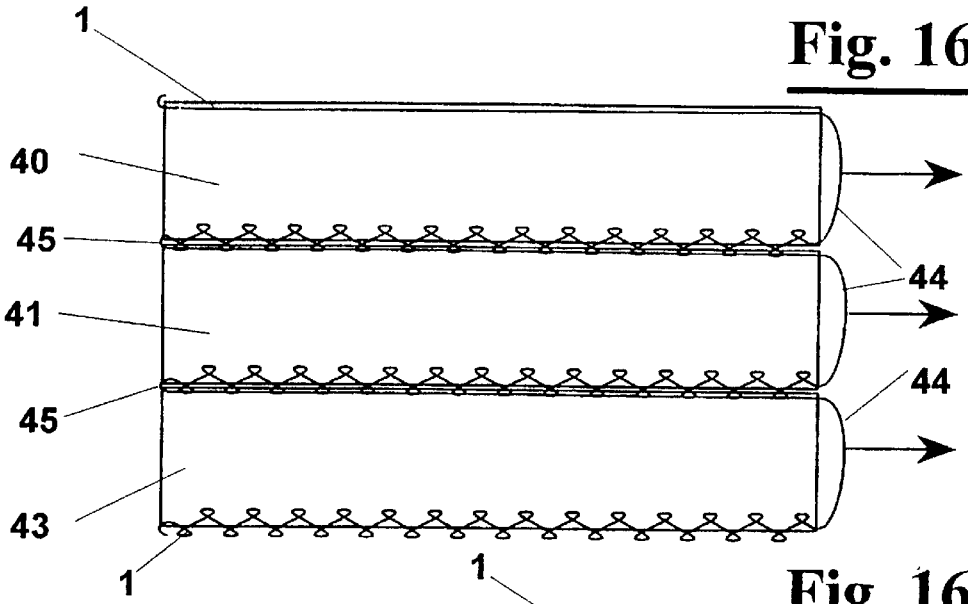
FIGS. 16A, B and C show three adjacent collars in three possible arrangements after knitting.
Figure 16B:
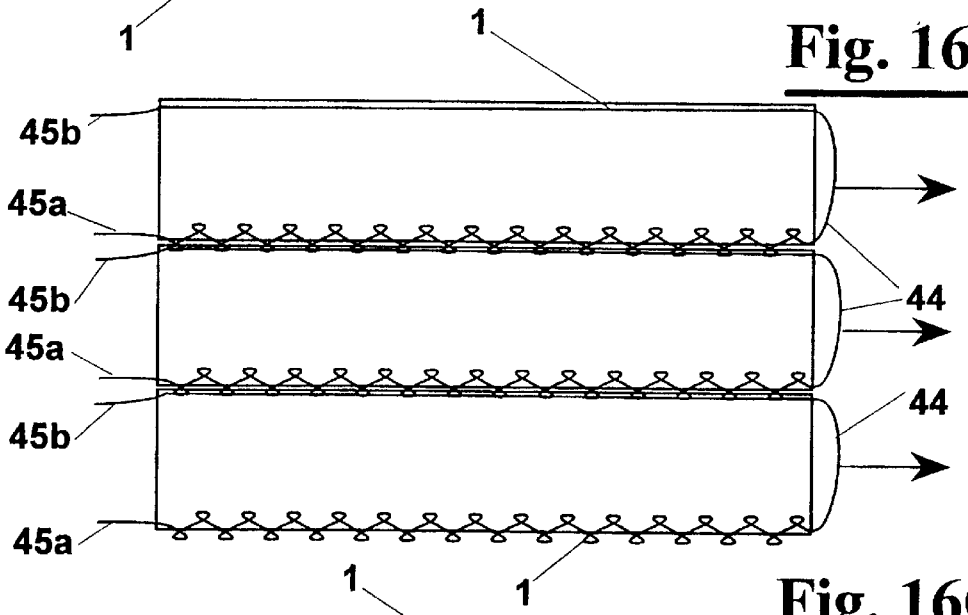
Figure 16C:
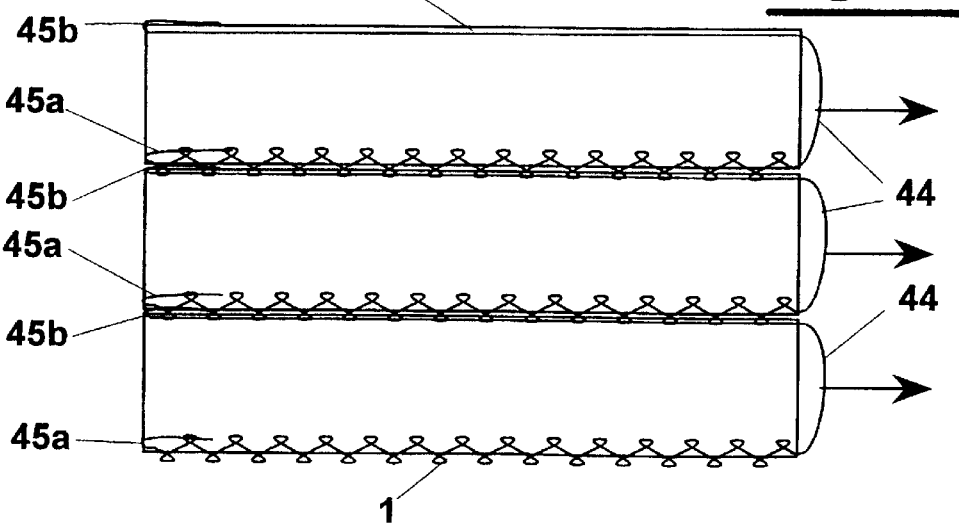

Reference is now made to FIGS. 16A, B and C, to describe the method for simplifying the separation step of the collars. The collars 40, 41 and 43 are kept attached to one another by a thread of union 1, which forms a loop 44 for each collar. When separating the collars, as shown in FIG. 16A, according to the known art, the thread of union 1 must be cut at 45, and then, by pulling the loops 44 in the direction of arrows 46, the thread of union unstitches easily and the collars remain alone. Since the cutting step of the thread of union at 45 is not easy to carry out automatically, because if the cut occurs in a slightly different position, the collar can be damaged, according to the present invention the cutting step of the thread of union at 45 is carried out while knitting, with the final result of FIG. 16B, freeing thread ends 45*a* and 45*b*. In this way, the separation step does not require any cutting operation and is easier. However, to prevent the thread of union 1 from being pulled inadvertently during the finishing of the collars (dyeing, washing), ends 45*a* and 45*b* are restrained as shown in FIG. 16C in the same way as described above. In this way, according to the invention, thread of union 1 can be pulled with a slightly stronger force than in the case of FIG. 16B, but with the advantage of preventing ends 45*a* and 45*b* from being pulled inadvertently.

Although reference has been made to jets of air for catching and inserting the end portions of thread, the successful use of jets of water has not been excluded, especially when the thread is particularly thick and heavy, in which case it would be necessary to use jets of air too powerful to control.

Furthermore, although reference has been made to fluid currents accomplished by mean:, of air or liquid jets, clearly it is equally possible to accomplish the object of catching and orienting the end portions of thread by means of air currents created by suction.

What is claimed is:

1. A knitting method for restraining, into stitches, an end portions of a cut thread protruding from an edge of a collar; the method comprising:

cutting said thread after knitting a first course of stitches, creating a free thread end protruding from said edge;

catching said thread with a fluid current;

aligning said thread end parallel to said first course of stitches via the fluid current; and stretching said thread end onto said first course of stitches; and then knitting a second course of stitches onto said first course of stitches.

2. The method according to claim 1 including passage of a brush, wherein said stretching step comprises lowering said brush onto said first course of stitches, touching said first thread end, and combing said first thread end.

3. The method according to claim 1 wherein said catching step comprises providing a first fluid current orthogonal to said first course of stitches and wherein said alignment step comprises providing a second fluid current parallel to said first course of stitches, said second fluid current being provided by a mobile emitter, and aligning said mobile emitter to said first course of stitches only at a moment of emission of said second fluid current.

4. The method according to claim 1, comprising sucking said free end, which protrudes from said first course of stitches, under said stitches via a fluid current.

5. The method according to claim 4, comprising producing said sucking fluid current via a mobile emitter located in a lowered position with respect to said first course of stitches.

6. The method according to claim 1, comprising separating collars for knit wear articles, wherein the collars are attached to one another by, a thread of union, the step of separating comprising cutting said thread of union forming two thread ends which are restrained in turn among collar stitches of said collar via said steps of catching, aligning, stretching and then knitting a second course of stitches.

7. A knitting apparatus applicable to a knitting machine for production of a collar, the apparatus being adapted for restraining an end portion of a cut thread protruding from an edge of said collar into stitches making up the collar; the apparatus comprising:

a cutter adapted to a cutting of said end portion to form a thread end;

a fluid-current emitter adapted to catching and alignment of said thread end with the stitches while knitting; and a brush adapted to combing said end portion of thread parallel to said stitches while knitting.

8. The apparatus according to claim 7, wherein said means for emitting said fluid current comprises a blowing head directed parallel to said stitches and a nozzle directed orthogonally to said stitches, said head and said nozzle being mounted on an actuator that raises them or lowers them with respect to said stitches while knitting.

9. The apparatus according to claim 7, wherein said means for emitting said fluid current comprises a first nozzle directed orthogonally to said stitches and a second nozzle directed parallel to said stitches, said second nozzle lying on the line of said stitches while knitting.

10. The apparatus according to claim 7, wherein said means for emitting said fluid current comprises a first nozzle directed orthogonally to said stitches and a second nozzle directed parallel to said stitches, said second nozzle lying on the line of said stitches while knitting, said second nozzle being mobile and adapted to rotate from a position orthogonal to said stitches to a position parallel to said stitches while knitting.

11. The apparatus according to claim 7, wherein said blowing head includes a central groove and a couple of eccentric parallel nozzles directed towards deflector means adapted to orient the fluid coming from said head parallel to said stitches while knitting.

12. The apparatus according to claim 7, wherein said cutting means comprise a mobile blade and a fixed blade, said mobile blade being placed above said fixed blade and including an upper inclined profile.

13. The apparatus according to claim 7, wherein plate means can be provided for on said knitting machine for preventing said thread end from being aligned outside a knitting line.

* * * * *